US010258993B1

(12) United States Patent
Moreland

(10) Patent No.: US 10,258,993 B1
(45) Date of Patent: Apr. 16, 2019

(54) PUNCH AND DIE MEDIA DESTRUCTION SYSTEM

(71) Applicant: Robert Allen Moreland, Keller, TX (US)

(72) Inventor: Robert Allen Moreland, Keller, TX (US)

( * ) Notice: Subject to any disclaimer, the term of this patent is extended or adjusted under 35 U.S.C. 154(b) by 364 days.

(21) Appl. No.: 15/348,781

(22) Filed: Nov. 10, 2016

Related U.S. Application Data

(60) Provisional application No. 62/253,368, filed on Nov. 10, 2015.

(51) Int. Cl.

| | |
|---|---|
| ***B02C 18/00*** | (2006.01) |
| ***B02C 18/14*** | (2006.01) |
| ***B02C 18/18*** | (2006.01) |
| ***B02C 18/04*** | (2006.01) |

(52) U.S. Cl.
CPC ..... *B02C 18/0007* (2013.01); *B02C 18/04* (2013.01); *B02C 18/142* (2013.01); *B02C 18/182* (2013.01)

(58) Field of Classification Search
CPC . B02C 18/142; B02C 18/0007; B02C 18/182; B02C 18/04
USPC ..... 241/236
See application file for complete search history.

(56) References Cited

U.S. PATENT DOCUMENTS

| | | | | |
|---|---|---|---|---|
| 7,311,279 | B2 * | 12/2007 | Mathers | B02C 18/142 241/166 |
| 9,103,210 | B2 * | 8/2015 | O'Connor | F01B 13/067 |
| 10,065,191 | B2 * | 9/2018 | Dick | B02C 4/30 |
| 2006/0228456 | A1 * | 10/2006 | Mihalos | A21D 13/40 426/549 |

* cited by examiner

*Primary Examiner* — Shelley M Self
*Assistant Examiner* — Bobby Yeonjin Kim
(74) *Attorney, Agent, or Firm* — Eldredge Law Firm, LLC; Richard Eldredge; Beth Felix

(57) ABSTRACT

A media shredder system includes a body forming an inner cavity; a punch cutter; a die cutter; and a driver. The punch cutter includes a punch cylindrical body with an outer surface; and a plurality of random oriented protrusions with sharp cutting edges, the protrusions are configured to protrude from the outer surface of the cylindrical body. The die cutter includes a die cylindrical body with an outer surface; and a plurality of dies extending inwardly from the outer surface of the die cylindrical body, the plurality of dies matching the plurality of random oriented protrusions. The driver simultaneously rotate the punch cutter and the die cutter.

1 Claim, 3 Drawing Sheets

PUNCH AND DIE MEDIA DESTRUCTION SYSTEM

BACKGROUND

1. Field of the Invention

The present invention relates generally to elliptical cutting systems, and more specifically, to a media shredding system for destroying paper, CDs, and the like.

2. Description of Related Art

Media shredding systems are well known in the art and are effective means to shred, cut and destroy what is placed in them. For example, FIG. 1 depicts a conventional media shredding system 101 which comprises paper 103, a shredding device 105 and shredded strips 107. During use, the paper 103 is fed into the shredding device 105 and is reduced to shredded strips 107.

One of the problems commonly associated with system 101 is that the shredded media can be reconstructed. For example, the common media shredding system 101 produces long strips that can be sorted through and put back together revealing the data on the media.

Accordingly, although great strides have been made in the area of media shredding systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

DETAILED DESCRIPTION OF THE PREFERRED EMBODIMENT

Figure 1:
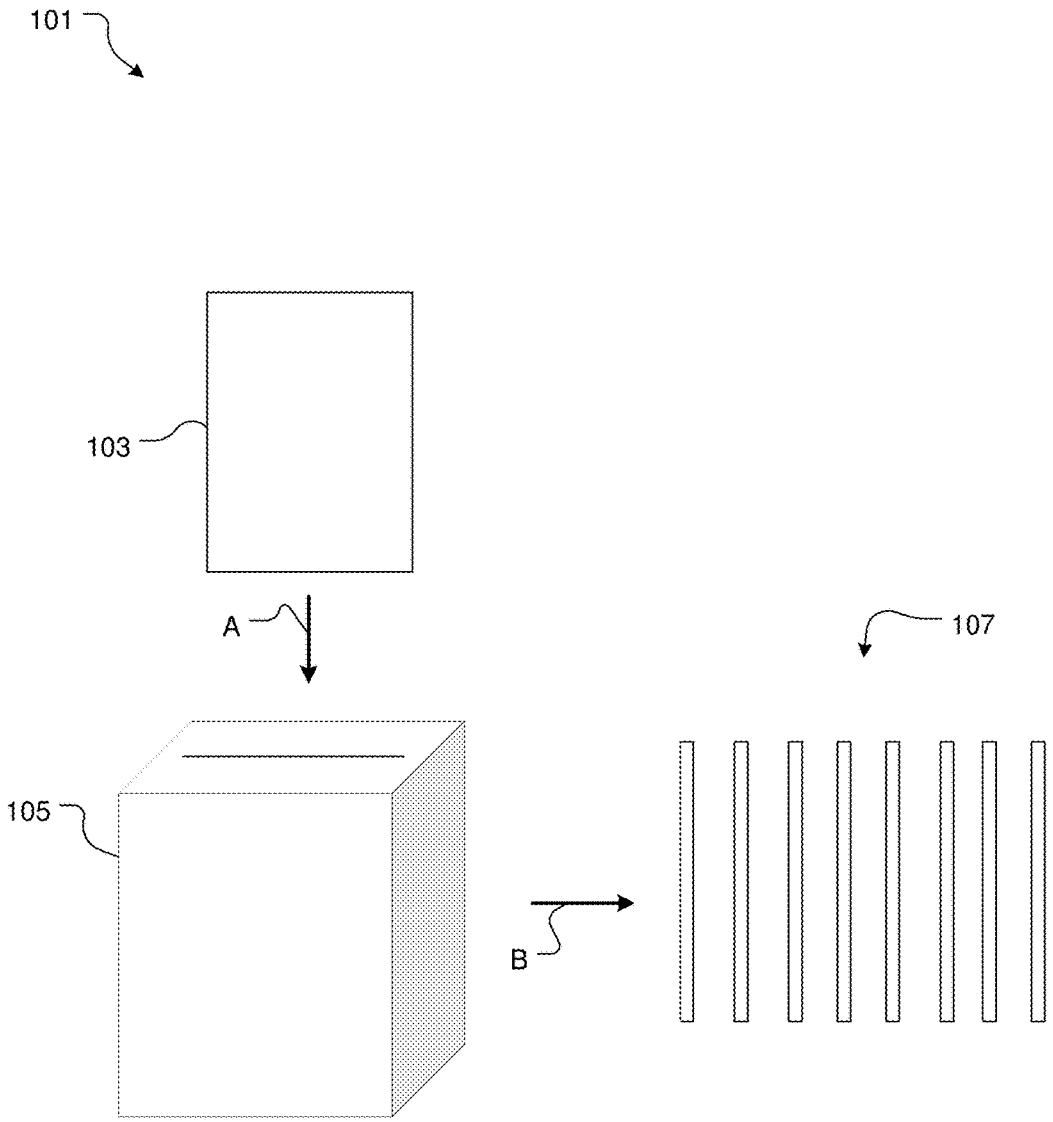
FIG. 1 (Prior Art)
FIG. 1 is a flow diagram of a common media shredding system.

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional media shredding systems. Specifically, the punch and die media destruction system produces random and irregular shredded pieces of media which significantly complicate the reconstruction of the destroyed media. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
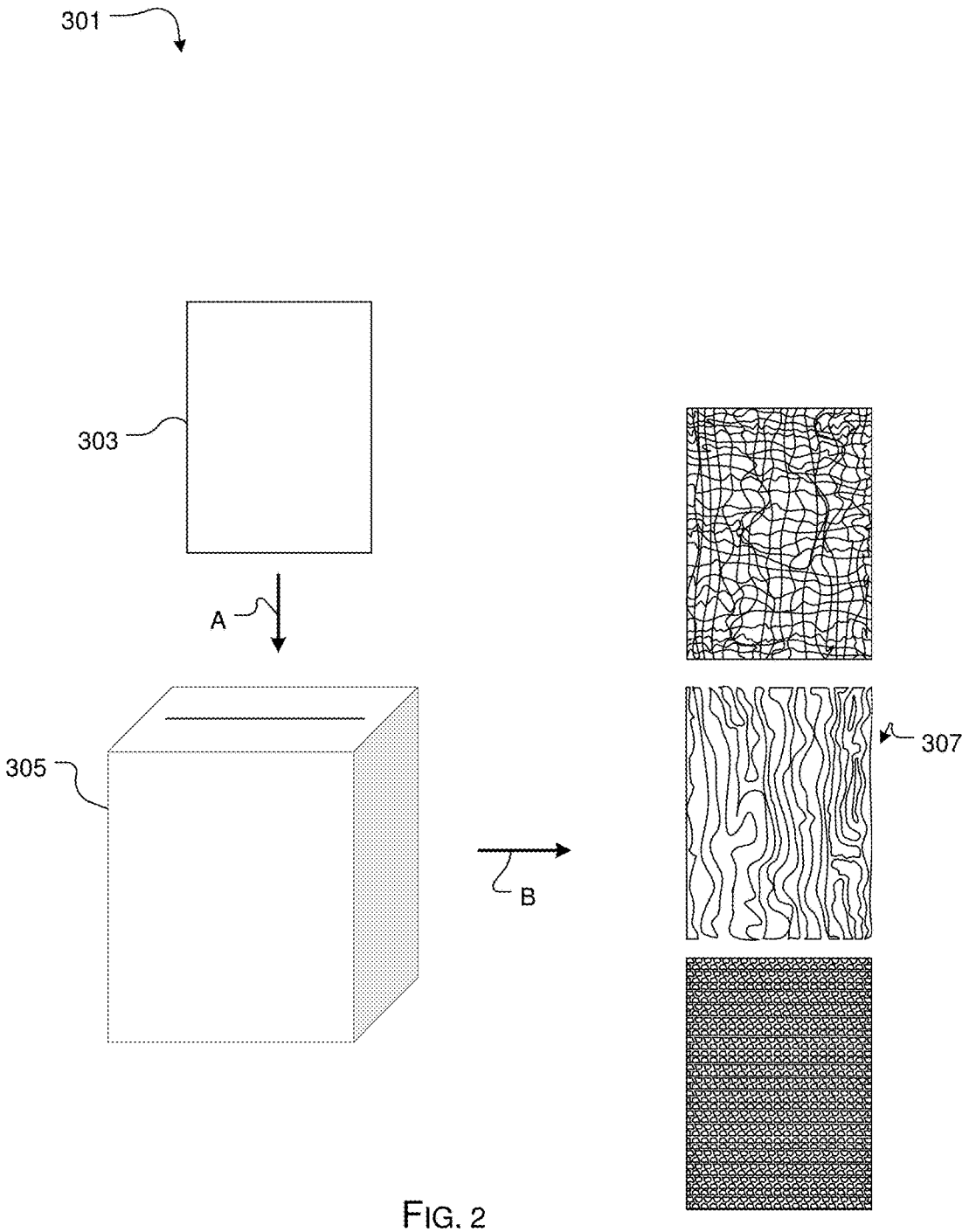
FIG. 2 is a flow diagram of a punch and die media destruction system in accordance with a preferred embodiment of the present application.

Referring now to the drawings wherein like reference characters identify corresponding or similar elements throughout the several views, FIG. 2 depicts a punch and die media destruction system 301 in accordance with a preferred embodiment of the present application. It will be appreciated that system 301 overcomes one or more of the above-listed problems commonly associated with conventional media shredding systems.

In the contemplated embodiment, system 301 comprises one or more pieces of media (paper 303 is shown) one or more punch and die media destruction devices 305, and the media remains 307. It will be appreciated that system 301 is a media shredder that could be utilized for paper, compact discs, and so forth.

Figure 3:
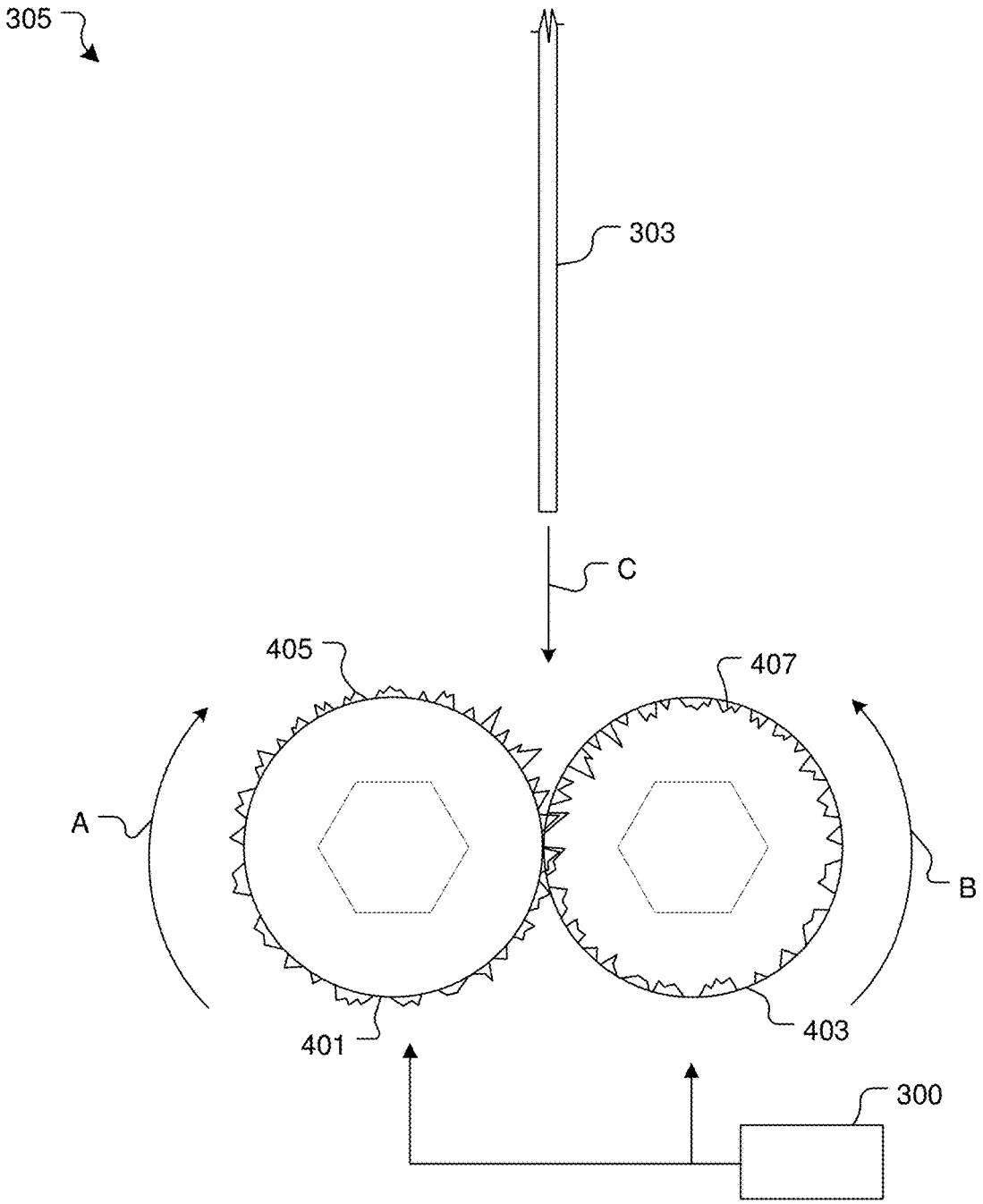
FIG. 3 is a side view of punch and die cutting system in accordance with a preferred embodiment of the present application; and While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

Referring now to FIG. 3, the punch and die media destruction device having a body 305 that forms an inner cavity with one or more punch cutters 401 and one or more die cutters 403 having circular bodies and driven by an electrical motor. Each punch cutter 401 has one or more protruding punch surfaces 405. These protruding punch surfaces 405 are random in spacing and size. The die cutter 403 has dies 407 spaced appropriately to receive the corresponding protruding punch surfaces 405, which protrude from the outer surface of the punch cutter 401. It is contemplated that the punch cutter 401 and die cutter 403 may be any length desired and function as a single set or in a plurality of sets. As depicted, the cutters rotated in opposing directions to each other "A" and "B" and are driven by a motor 300.

It should be appreciated that one of the unique features believed characteristic of the present application is the randomization of the protruding punch surfaces 405 resulting in random sized shredded pieces.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A media shredder system, comprising:

a body forming an inner cavity;

a punch cutter having:

a punch cylindrical body with an outer surface; and a plurality of random oriented protrusions with sharp cutting edges, the protrusions are configured to protrude from the outer surface of the cylindrical body;

wherein each of the plurality of random oriented protrusions have different oriented sharp cutting edges;

a die cutter having:

a die cylindrical body with an outer surface; and a plurality of dies extending inwardly from the outer surface of the die cylindrical body, the plurality of dies matching the plurality of random oriented protrusions;

wherein the plurality of random oriented protrusions fit within the plurality of dies; and a driver configured to simultaneously rotate the punch cutter and the die cutter;

wherein the punch cutter rotates in a direction opposite to the die cutter.

* * * * *